US010633818B2

(12) United States Patent
Spiro

(10) Patent No.: US 10,633,818 B2
(45) Date of Patent: Apr. 28, 2020

(54) UNIVERSAL POLE FOUNDATION WITH INSTANT CAP

(71) Applicant: Daniel S. Spiro, Scottsdale, AZ (US)

(72) Inventor: Daniel S. Spiro, Scottsdale, AZ (US)

( * ) Notice: Subject to any disclaimer, the term of this patent is extended or adjusted under 35 U.S.C. 154(b) by 0 days.

(21) Appl. No.: 16/200,927

(22) Filed: Nov. 27, 2018

(65) Prior Publication Data

US 2019/0093304 A1 Mar. 28, 2019

Related U.S. Application Data

(63) Continuation-in-part of application No. 15/722,910, filed on Oct. 2, 2017, now Pat. No. 10,280,581, which (Continued)

(51) Int. Cl.
*E02D 27/42* (2006.01)
*E04H 12/22* (2006.01)

(52) U.S. Cl.
CPC ..... *E02D 27/42* (2013.01); *E04H 12/2215* (2013.01); *E04H 12/2269* (2013.01); *E04H 12/2284* (2013.01); *E04H 12/2292* (2013.01); *E02D 2300/00* (2013.01); *E02D 2600/00* (2013.01)

(58) Field of Classification Search
CPC . E02D 27/42; E02D 2300/00; E02D 2600/00; E04H 12/2292; E04H 12/2284; E04H 12/2269
See application file for complete search history.

(56) References Cited

U.S. PATENT DOCUMENTS 1,611,935 A 12/1926 Mitchell
1,799,314 A 4/1931 Pfaff
(Continued)

FOREIGN PATENT DOCUMENTS

EP 0153545 A1 * 9/1985 ..... E02D 27/42

OTHER PUBLICATIONS

Spiro, Daniel S. Universal Pole Foundation, Patent Cooperation Treaty Application Serial No. PCT/US2018/13148, filed Jan. 10, 2018, International Search Report and Written Opinion dated May 1, 2018.
(Continued)

*Primary Examiner* — Patrick J Maestri
(74) *Attorney, Agent, or Firm* — Schmeiser, Olsen & Watts LLP

(57) ABSTRACT

An instant cap ("I-Cap") for a pole foundation and an all-in-one universal pole foundation are provided. The I-Cap is a just-in-time manufactured device located at the foundation's top, filling the gap between the pole foundation cavity's inner wall and the pole. The I-Cap transfers lateral pole forces to the foundation wall while providing pole cavity moisture protection as well as protection from pole uplift and rotation forces. Both the pole and the foundation are manufactured to precision. The all-in-one universal pole foundation can be manufactured just-in-time having information at hand about the pole shaft dimensions specified. The pole rests on either a flat or tapered structure at the bottom of the pole cavity with a through opening to enable moisture to evacuate the cavity. The pole is secured to the foundation using at least one through bolts.

20 Claims, 12 Drawing Sheets

Related U.S. Application Data is a continuation of application No. 15/404,051, filed on Jan. 11, 2017, now Pat. No. 9,776,456.

(60) Provisional application No. 62/590,831, filed on Nov. 27, 2017, provisional application No. 62/590,837, filed on Nov. 27, 2017.

(56) References Cited

U.S. PATENT DOCUMENTS

| | | | |
|---|---|---|---|
| 5,632,464 | A | 5/1997 | Aberle |
| 6,494,643 | B1 | 12/2002 | Thurner |
| 7,765,770 | B2 | 6/2010 | Fournier |
| 7,954,289 | B2 | 6/2011 | Evans |
| 8,966,837 | B2 | 3/2015 | Knudsen |
| 9,777,456 | B1 | 1/2017 | Spiro |
| 10,280,581 | B2 | 5/2019 | Spiro |
| 2005/0051695 | A1 | 3/2005 | Kovach |
| 2007/0022706 | A1 | 2/2007 | Fournier |
| 2013/0212966 | A1 | 8/2013 | Knudsen |
| 2018/0195305 | A1 | 7/2018 | Bishop, III et al. |

OTHER PUBLICATIONS https://www.satelliteguys.us/xen/threads/mounting-dish-in-a-bucked-of-concrete.20219/ (Year:2004).

https://web.archive.org/web/20070120094657/http://www.wikihow.com/Installl-a-Temporary-Mail-Box-Without-a-Post-Hold-Digger (Year: 2006).

* cited by examiner

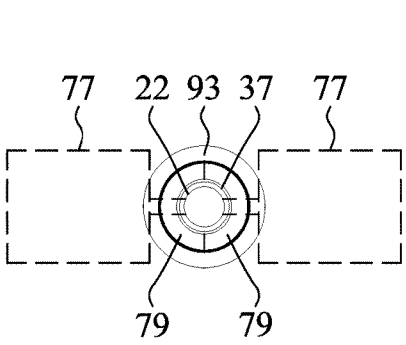
FIG 1A
FIG 1C
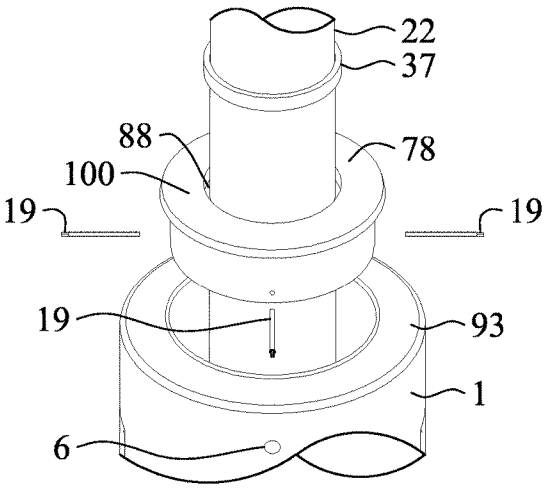
FIG 1E
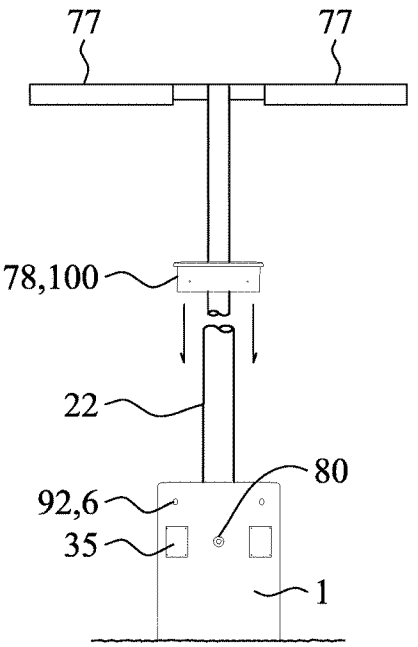
FIG 1B
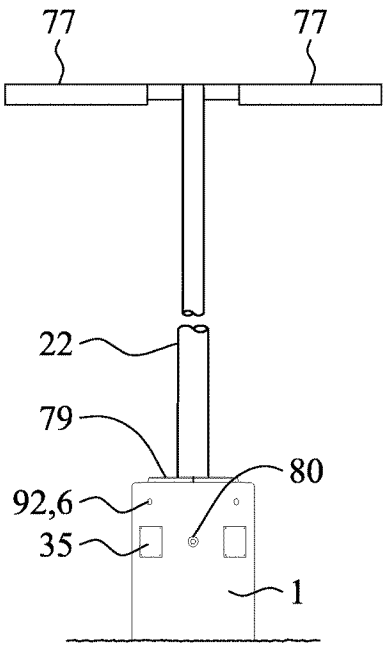
FIG 1D
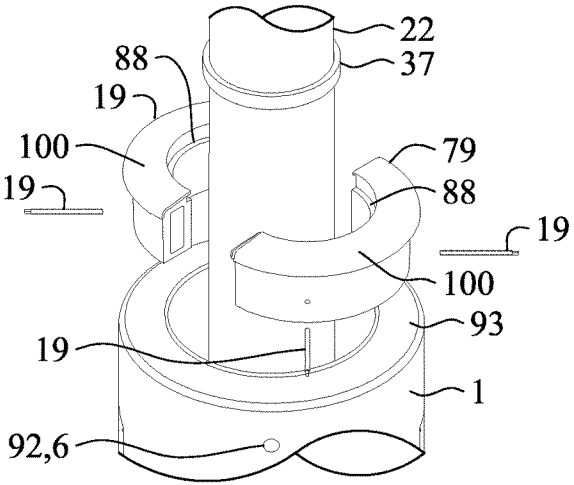
FIG 1F

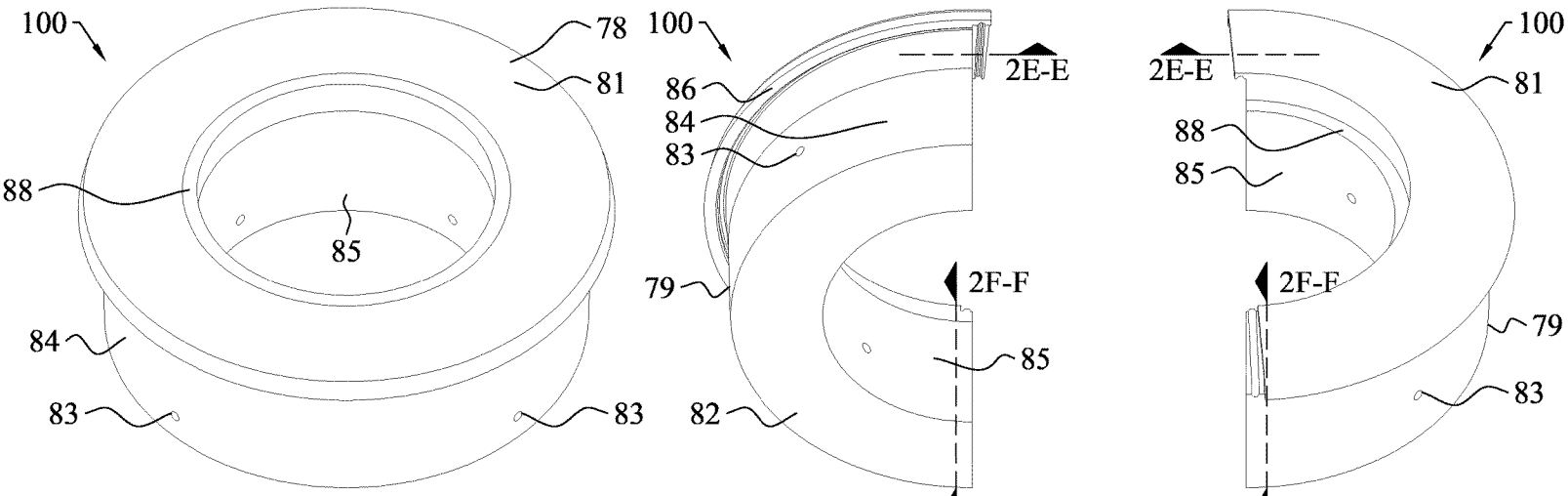
FIG 2A
FIG 2C
FIG 2D
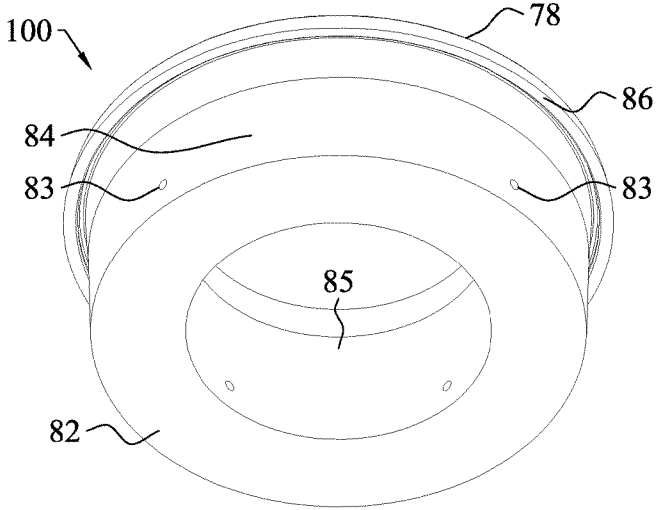
FIG 2B
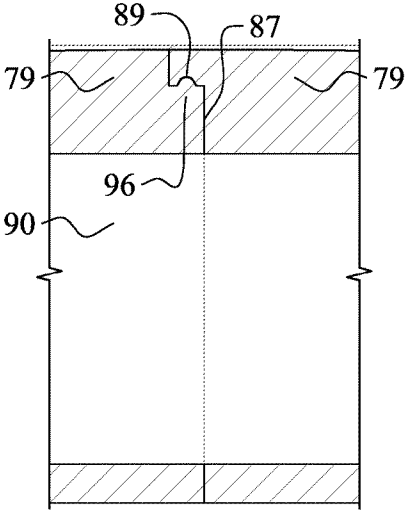
FIG 2E-E
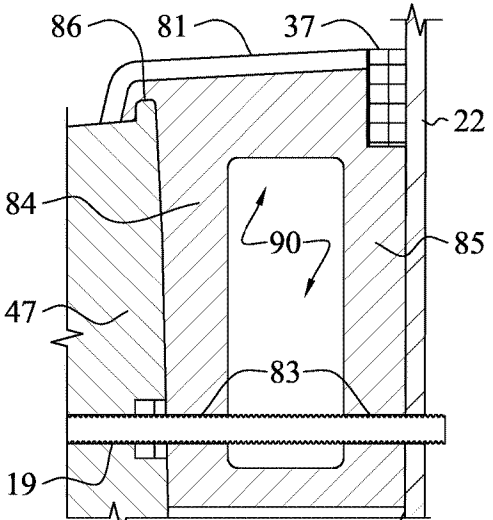
FIG 2F-F

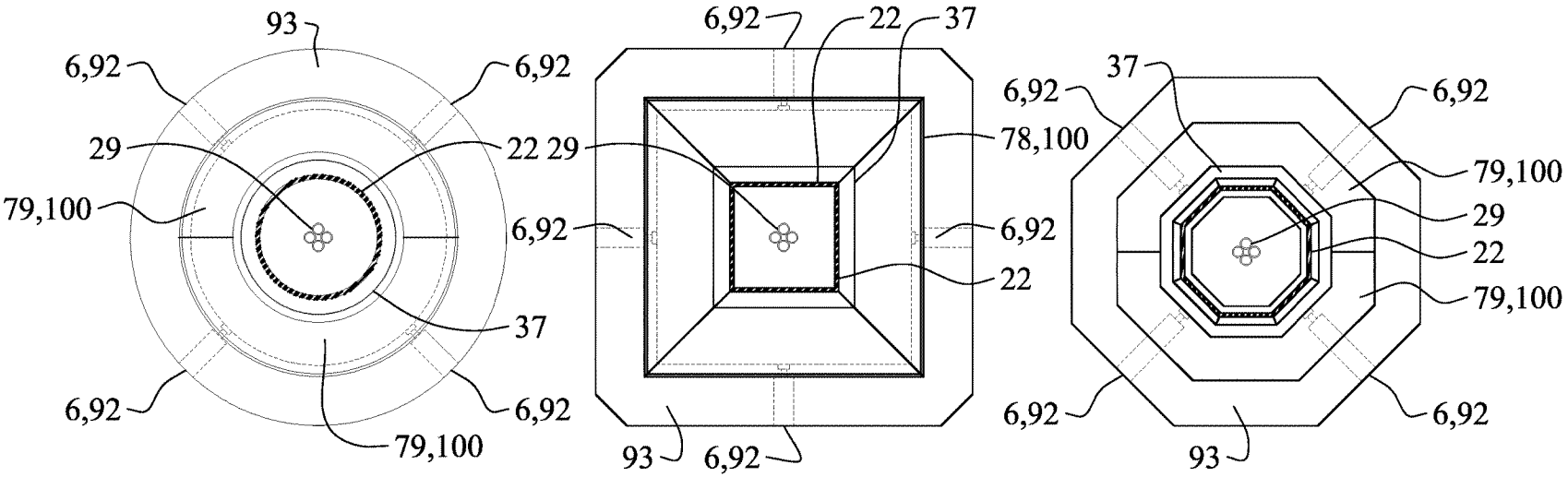
FIG 4A
FIG 4C
FIG 4E
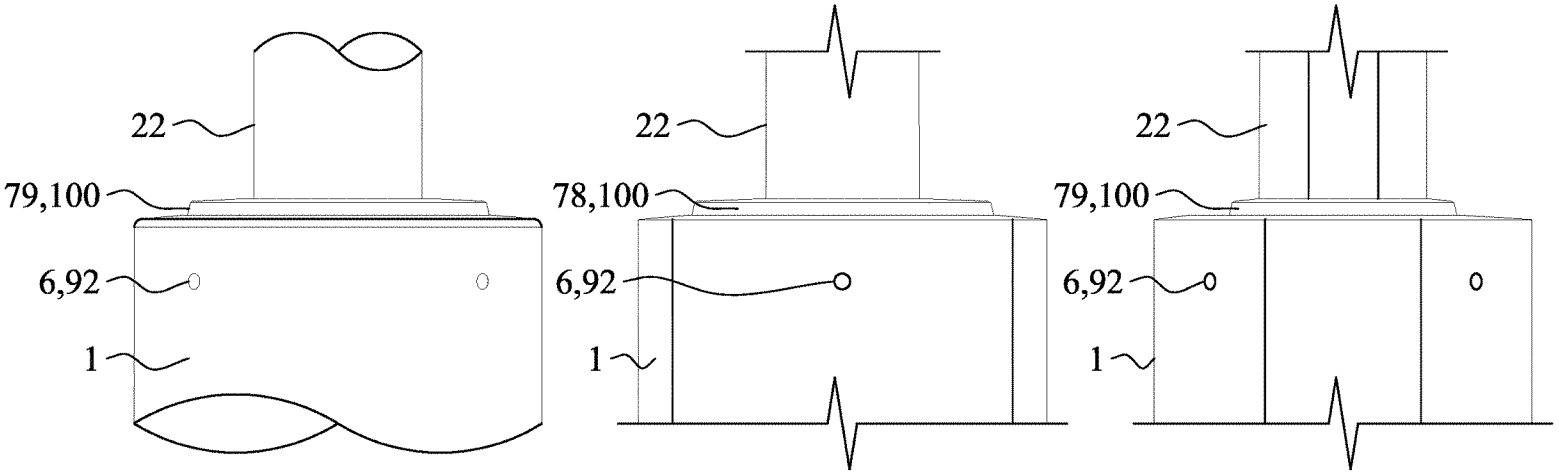
FIG 4B
FIG 4D
FIG 4F

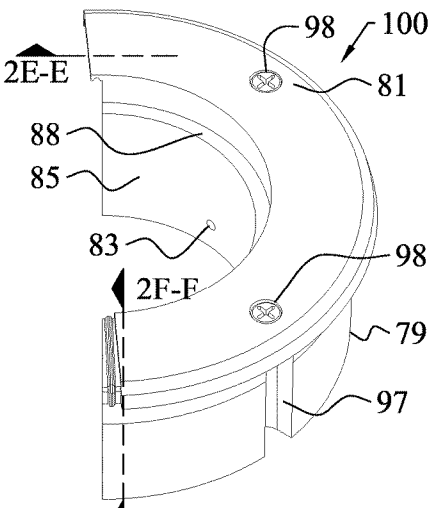
FIG 6D
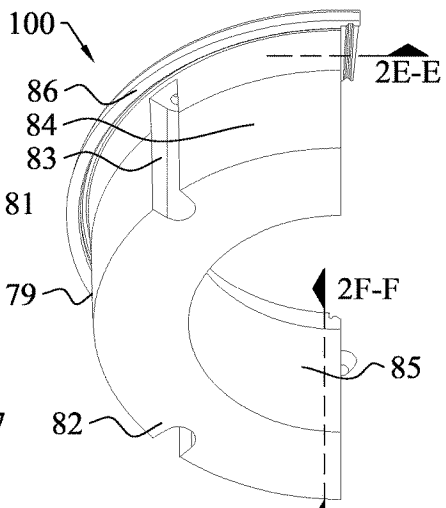
FIG 6C
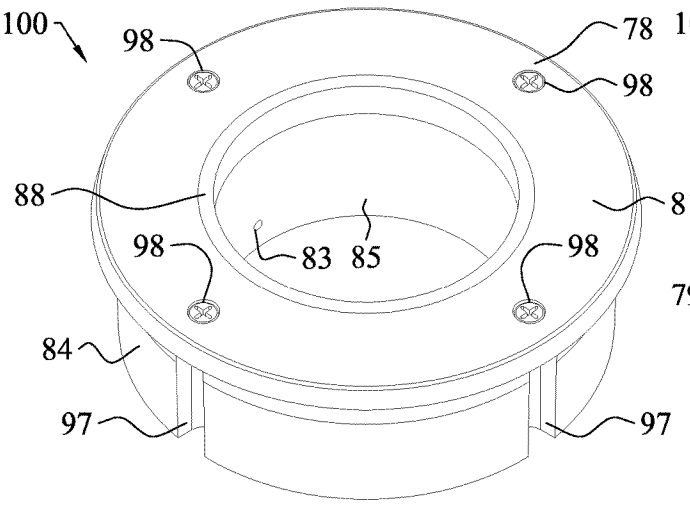
FIG 6A
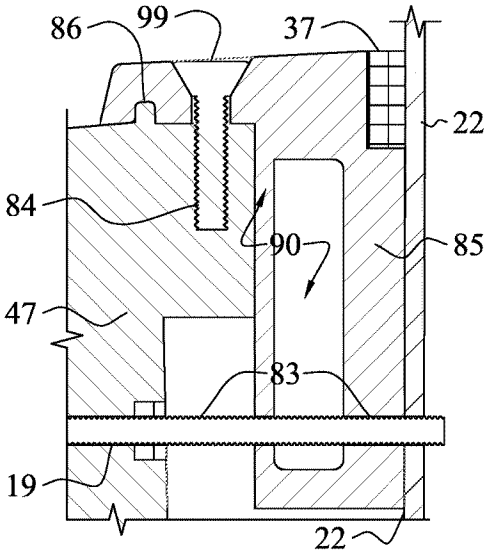
FIG 6F-F
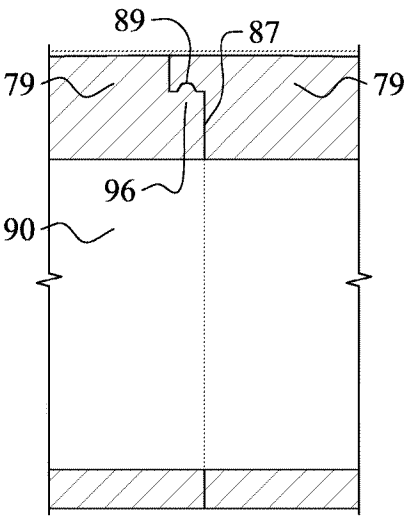
FIG 6E-E
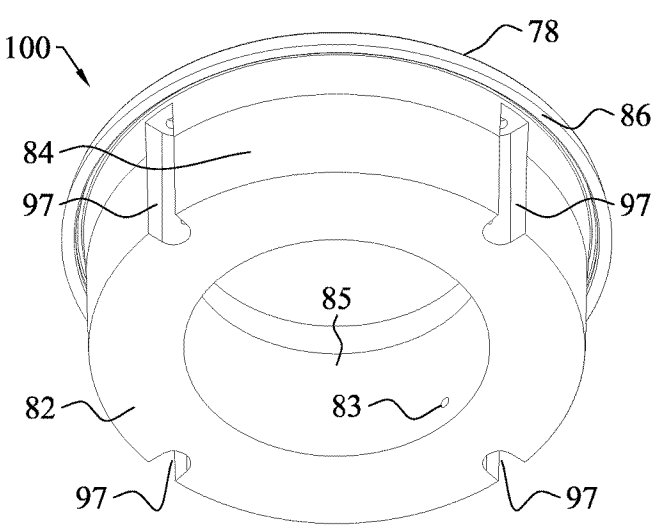
FIG 6B

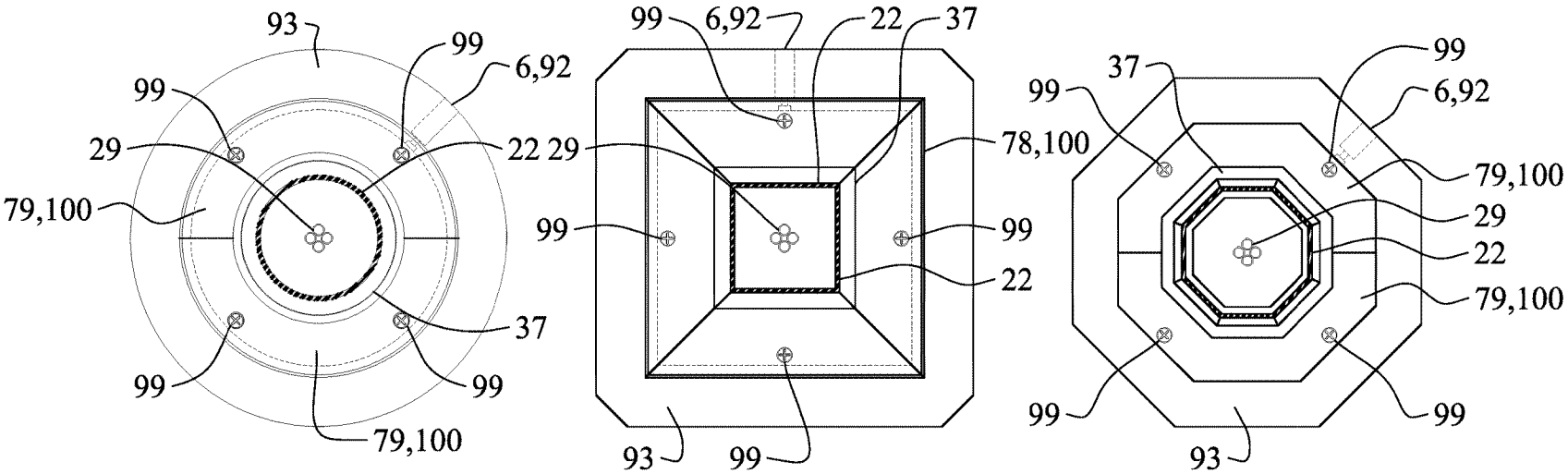
FIG 8A
FIG 8C
FIG 8E
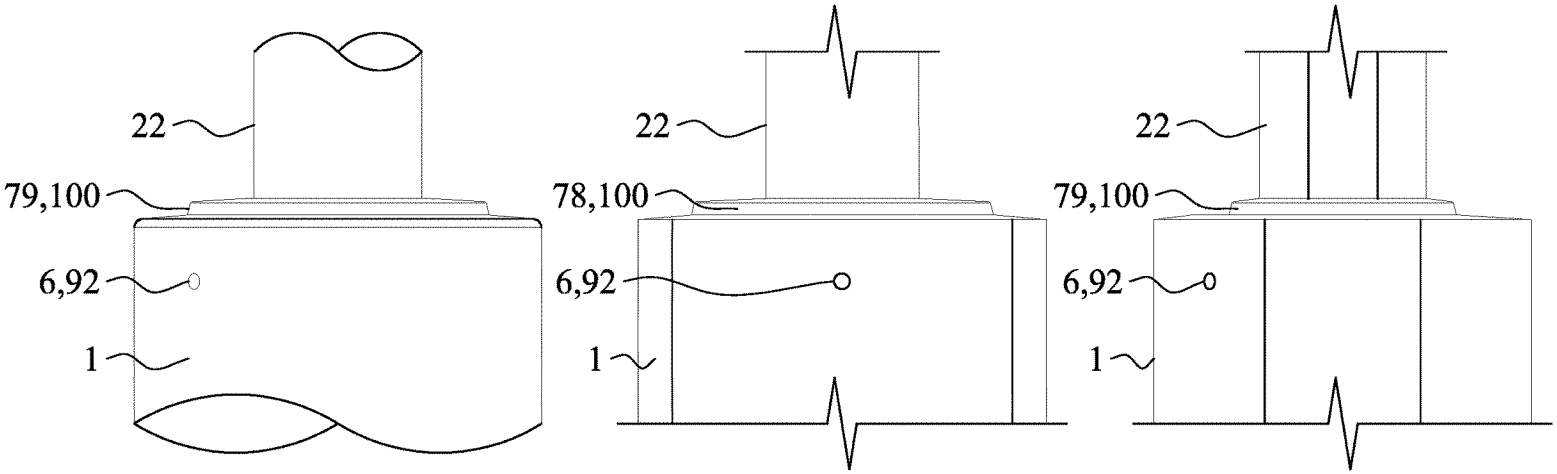
FIG 8B
FIG 8D
FIG 8F

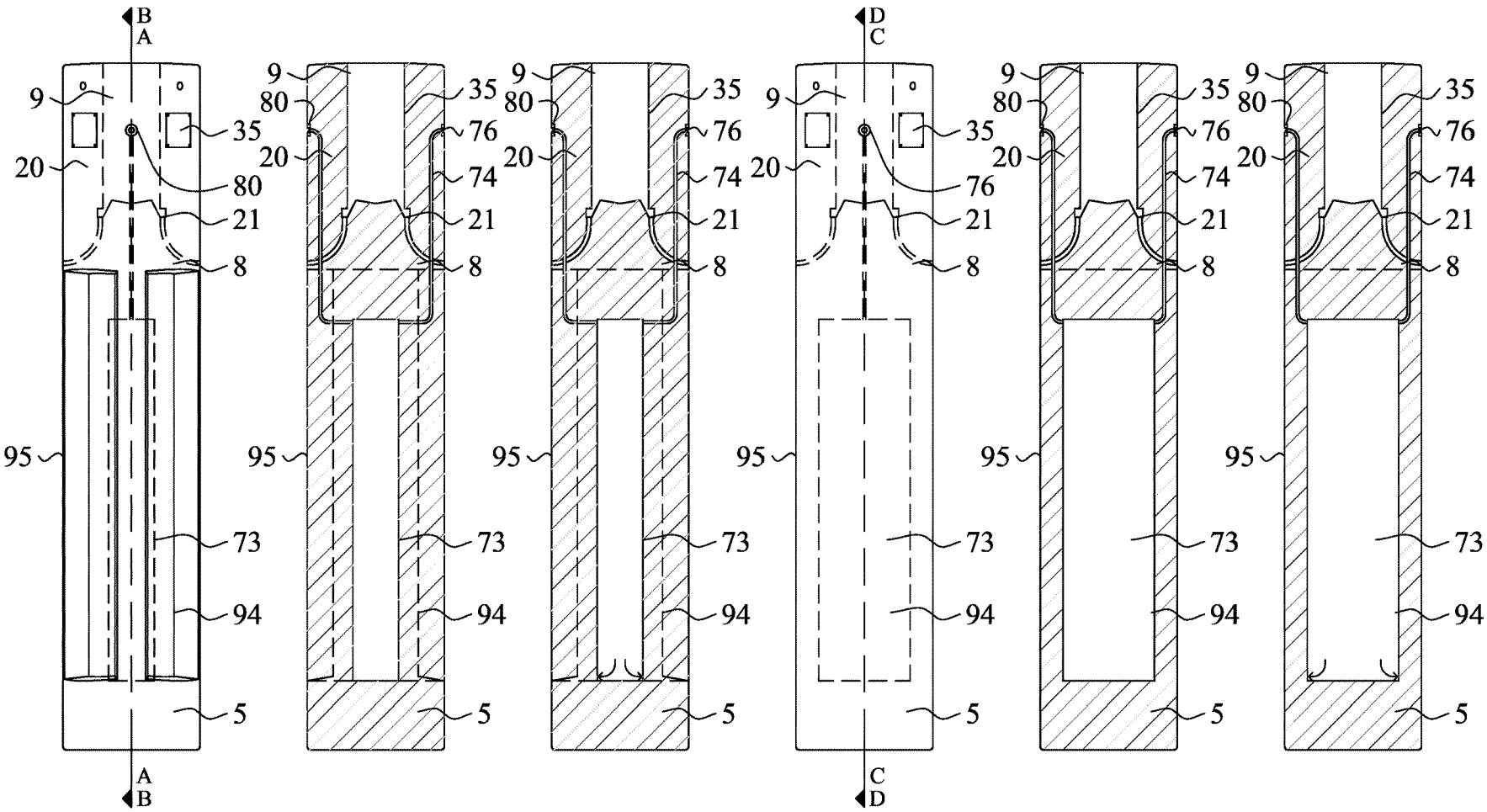
FIG. 10A FIG. 10A-A FIG. 10B FIG. 10B-B FIG. 10C-C FIG. 10D-D

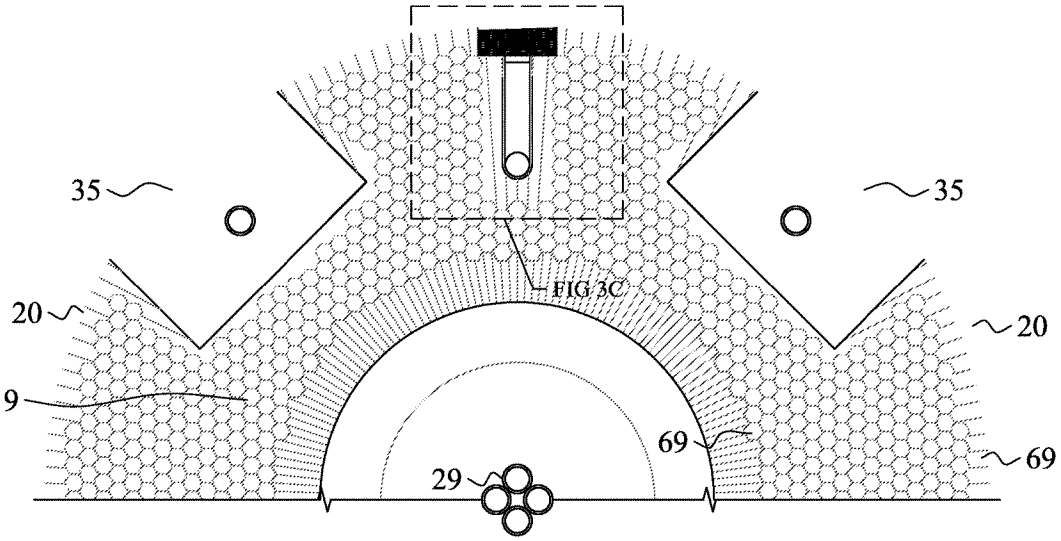
FIG. 11A-A
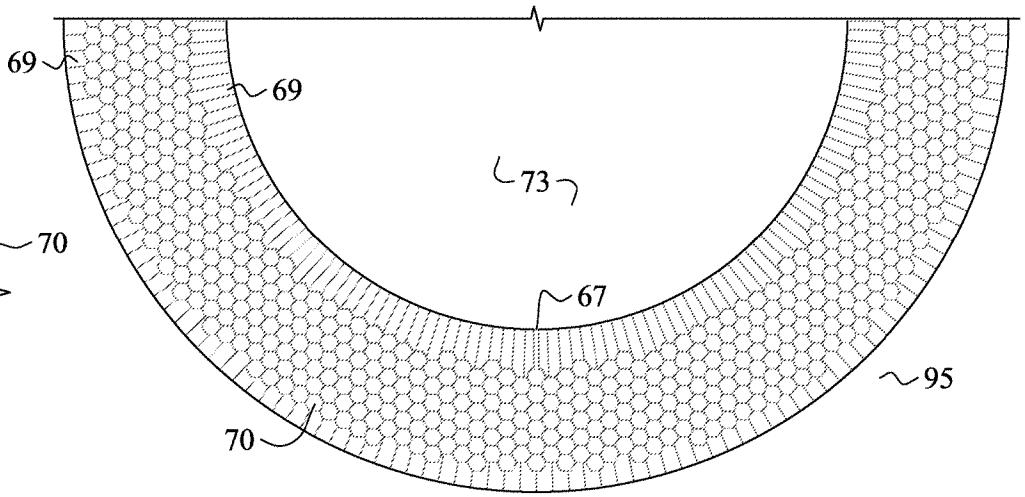
FIG. 11B-B
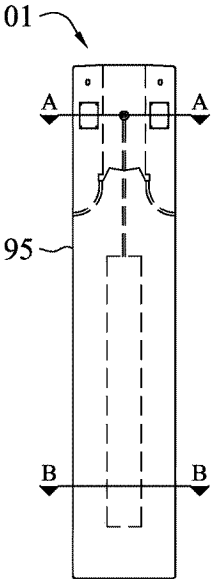
FIG. 11A
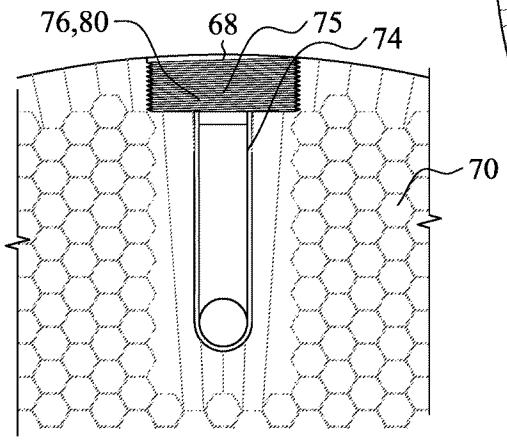
FIG. 11C

UNIVERSAL POLE FOUNDATION WITH INSTANT CAP

CROSS REFERENCE TO RELATED APPLICATION[S]

This application is a continuation-in-part of the earlier U.S. Utility patent application entitled "UNIVERSAL POLE FOUNDATION," Ser. No. 15/722,910, filed Oct. 2, 2017, which is a continuation of the earlier U.S. Utility patent application entitled "UNIVERSAL POLE FOUNDATION," Ser. No. 15/404,051, filed Jan. 11, 2017, now U.S. Pat. No. 9,776,456, and further claims priority to Provisional patent application having Ser. No. 62/590,837, filed Nov. 27, 2017 and claims priority to Provisional patent application having Ser. No. 62/590,831, filed Nov. 27, 2017, the disclosures of which are hereby incorporated entirely herein by reference.

BACKGROUND OF THE INVENTION

Technical Field

The innovation is in the field of construction, more specifically in the means and methods of foundation construction.

State of the Art

Conventional pole erection having a base plate requires lowering a pole onto a foundation with embedded threaded anchor bolts. The threaded anchor bolts pass through the pole's base plate. The pole is then secured to the foundation and then plumbed. The entire process of erecting a conventional pole and foundation is lengthy, requiring coordination between material suppliers and construction trades. The construction process is time sensitive. Coordinating multiple parties comes with risks of delay. These delay risks are compounded when having to work in outdoor conditions subject to unpredictable weather. Other drawbacks to the conventional pole erection method include: use of pole base plate adds cost to the pole and is foundation-specific, governed by anchor bolt bore spacing, having to refinish the above grade portion of the foundation following pole erection, corrosion exposure requiring periodic inspections and occasional maintenance work. The construction industry has a persistent need for an economical and rapid installation solution for erecting poles eliminating the drawbacks of the conventional means and methods.

SUMMARY OF THE INVENTION

This innovation streamlines the pole erection process by reducing steps described in the parent patent and continuation 01. The step reduction is accomplished by employing an all-in-one device called the I-cap enclosure device. The I-cap can facilitate both straight and tapered poles' lateral force/s transfer to foundation wall/s, resist pole uplift and/or rotation forces, provide pole plumbing while preventing moisture travel into the foundation's pole cavity. The features described can be all accomplished employing the I-cap with as little as a single through bolt.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIGS. 1A-1B and 1C-1D show two pole assemblies top and side views. FIGS. 1E and 1F show enlargements of two embodiments;

FIGS. 2A-2B and FIGS. 2C and 2D show top and bottom perspective views of the I-Cap embodiment types with side entry bolts. FIG. 2E-E and FIG. 2F-F enlarged longitudinal and transverse sections of the I-cap;

FIGS. 4A-4F show in top and side view different pole and foundation profile embodiments using the side entry lock bolts I-cap;

FIGS. 6A-6B and FIGS. 6C-6D show top and bottom perspective views of the I-Cap embodiment types with top and side entry bolts. FIG. 6E-E and FIG. 6F-F enlarged longitudinal and transverse sections of the I-cap;

FIGS. 8A-8F show in top and side view different pole foundation profile embodiments using the top entry lock bolt I-cap;

FIGS. 10A-10D-D show the foundation and pole embedment process.

FIG. 11A show a diagram of the foundation elevation with section designators.

FIGS. 11A-A and 11B-B show partial sections of a foundation embodiment's pole cavity and core sections.

FIG. 11C shows an enlargement of the pole cavity wall.

DETAILED DESCRIPTION OF EMBODIMENTS OF THE INVENTION

First Embodiment

Pole Foundation Erection Process

Figure 3C:
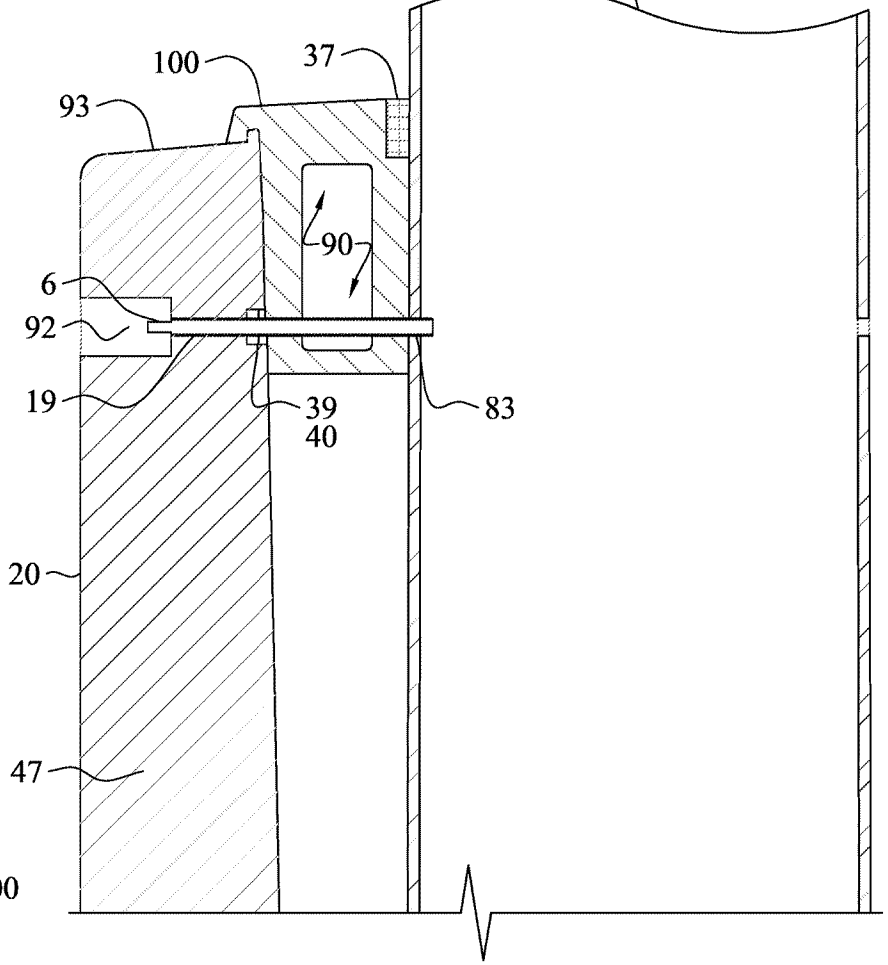
FIG. 3C shows an enlarged section of the I-Cap at the top of the foundation.

The conventional "pour-in-place" pole foundation construction and erection process entails the following steps:

a. Ordering materials such as steel rebar, gravel, plywood, and forms;
b. Scheduling onsite drop ship dates for the above materials;
c. Ordering luminaires and poles, often requiring that anchor bolts pre-ship prior to balance of order arrival;

d. Constructing the steel cage for the concrete foundation structural reinforcement;
e. Constructing plywood templates for the anchor bolts and secure the bolts with the template to cage;
f. Scheduling a date for concrete pour;
g. Augering foundation bores and, where needed, providing bedding material for the foundation (weather permitting);
h. Dropping forms with rebar cage into bores, plum and secure them, or dropping the steel rebar cages into forms after the forms were plumbed and secured in bores. The steel rebar cages could be inserted inside the form or following;
i. Making all pre-pour electrical connectivity prep work;
j. Backfilling and compacting soil around the forms if needed;
k. Scheduling a crane for pole standing;
l. Pouring concrete, vibrating inside the forms and waiting until concrete cures (weather permitting);
m. Assembling pole and luminaire(s) and/or other devices;
n. Using a crane, lower pole assembly on pole base securing pole to foundation with anchor bolts nuts;
o. Adjusting anchor bolts' nuts to plumb the pole;
p. Removing above grade forms and refinishing the foundation surfaces;
q. Pulling all electrical wire and securing the hand hole cover to pole;
r. Placing pole base cover or architectural nut covers on pole base plate;
s. Refinishing/touching up any scratches, and removing dirt from pole and foundation base; and
t. Powering up pole-mounted devices and verifying proper operation The present innovation of pole foundation construction and pole erection process entails the following steps:

a. Ordering foundation, foundation components, pole and luminaires;
b. Augering bores in the soil and bedding the bores' bottom if needed;
c. Dropping pre-casted foundation into the bores;
d. Pulling below grade power into the foundation;
e. Backfilling and compacting soil around the foundation;
f. Dropping a pole with luminaires, absent a base plate, into the foundation pole cavity;
g. Inserting the I-cap into position and then securing the pole assembly;
h. Sealing gap between pole and I-Cap with elastomeric compound;
i. Touching up any scratches and removing dirt from pole and foundation base; and
j. Trimming all electrical connections, powering up and verifying that all luminaires and/or other devices operate properly.

Coupled with the art described in the parent patent and continuation 01, the I-cap enclosure device eliminates 10 steps from the conventional foundation construction and pole erection.

The I-Cap is prefabricated using state of the art manufacturing technologies that significantly reduce the pole erection time. This reduction lowers the overall production costs and the likelihood of bad weather having an adverse impact on the construction schedule. The innovation enhances its parent patent and continuation 01, consolidating and streamlining processes and means into an all-in-one device.

About the I-Cap

The I-Cap is a just-in-time manufactured device located at the foundation's 1 top, filling the gap between the pole foundation cavity's 9 inner wall and the pole 22, while also providing cavity moisture protection. State of the art technology is capable of producing complex forms in real time. Today, for example, manufacturing by means of 3D printing can produce components at the Space Station by transmitting 3D files from Earth in real time. At the time an order is placed for a prefabricated pole foundation 1 and pole 22, both the inner diameter of the pole cavity 9 and the outer diameter of the pole 22 are known. Both the pole and the foundation are manufactured to precision. A computer program then produces the I-Cap's 100 manufacturing data configuring the physical form of the embodiment, the structural design and choice of material.

The I-Cap all-in-one enclosure device:

a. Transfers the pole's lateral forces to the foundation's walls;
b. Is the pole's anti-rotation lock;
c. Is the pole's anti-uplift lock;
d. Prevents moisture from entering the foundation's pole cavity;
e. In concert with the tapered structure at the bottom of the foundation's pole cavity plumb the pole: and
f. Eliminates the need to fill the pole foundation cavity with fill material to transfer lateral loads to the foundation's walls. The fill may be used only to ballast the foundation where needed.

The present innovation employs the two key elements of the parent patent: a tapered structure 21 at the pole cavity's 9 bottom center, and at least one anti-rotation bolt 25,48 inserted through the pole cavity's walls 20. The bolt 25,48 can be inserted to engage the pole 22 along most of the pole section embedded inside the foundation's pole cavity 9 except at the very top and bottom. No bolt 25,48 is needed to plumb the pole as the I-Cap enclosure plumbs the pole. An alternate embodiment with bolts securing the I-cap 100 to the foundation structure from above may employ only a single horizontal bolt 25,48 below the I-Cap to prevent the pole from rotation (not shown). In several foundations configuration the I-Cap 100 enclosure enables pouring ballasting fill material 17 through the pole cavity to the foundation base section 5 as well as inserting a vibrator to compact the fill material. The I-Cap eliminate the need to employ fill material 17 to transfer lateral pole forces to the foundation's walls 20.

The I-Cap enclosure device 100 is fabricated from organic or inorganic substantially non-corrosive hardened material, resistant to the elements. The device structure can be constructed of one or a series of volumetric enclosures 73 or a cellular structure 70 with a plurality of small voids. The device manufacturing methods include but are not limited to 3D printing and injection molding. The device form is adaptable to complement the form of the pole foundation cavity's 9 inner wall and the form of the pole 22. The I-Cap 100 form can be square, round or shaped to take any other form complementing both the structural and architectural requirements. The I-Cap 100 can be fabricated from a monolithic embodiment, or made of several embodiments joined together. The monolithic embodiment is typically inserted at the narrow side of the pole 22 shaft, and then slides into position at the top of the foundation pole cavity 9. The multi-component embodiment assembly is inserted at the top of the pole foundation cavity 9. Both the monolithic and the multi-component embodiments have a recess 88 in their interior wall perimeters. The I-Cap is secured to the foundation from above or from the pole foundation cavity wall using bolts 25,48, and then, the recess is filled in with an elastomeric compound to prevent moisture from travelling into the foundation pole cavity 9. The top mounted bolt I-Cap 100 walls have a keyed lock 97 to accommodate a foundation keyed lock 101 in the foundation's pole cavity walls. The foundation's keyed lock has a threaded bore 102 to which the I-Cap top bolt/s 99 mount to. The I-Cap can be removed and re-installed as the pole and the foundation.

The I-Cap possesses the following common properties, regardless of its form:

a. It has at least one through bore in its body to enable bolts to secure it to the foundation. The bore may be threaded or non-threaded threaded/inserted from the top face or from its side.
b. It may employ a separate bolt to secure the pole against uplift and/or rotation.
c. Its outer circumference, in part or in whole, abuts the inner face of the pole foundation cavity.
d. Its inner circumference, in part or in whole, abuts the pole's outer circumference.
e. Its exterior top face slopes away from the pole.
f. It extends outwardly beyond the inner wall of the pole foundation cavity having an overhung lip/ledge preventing moisture travel into the pole cavity.
g. It has a recess at its top exterior face for placement of elastomeric compound to prevent moisture travel into the pole foundation cavity.

FIG. 1A shows a plan view of a pole assembly employing two luminaires 77 resting in a pre-fabricated foundation 1 with a monolithic I-cap enclosure 78 engaging the pole 22 in the foundation's pole cavity 9.

FIG. 1B shows the assembly of FIG. 1A in elevation with the monolithic I-cap enclosure 78 lowered along the pole 22 shaft into position upon resting the pole assembly on the tapered structure 21 at the bottom of the pole cavity 9. Also shown is an inlet spout 80 to pour fluid 72 into the foundation 1. Electrical/data devices enclosure 35 and leader bore to facilitate engaging, plumbing and securing the pole 22 assembly employing the I-cap 100 to the foundation 1.

FIG. 1C shows a plan view of the pole assembly employing two luminaires 77 resting in a pre-fabricated foundation 1 with multi-part I-cap enclosure 79 engaging the pole in the foundation's pole cavity 9.

FIG. 1D shows the assembly of FIG. 1C in elevation with the multi-part I-cap enclosure 79 engaging the pole 22 and the foundation 1 and providing moisture protection to the pole cavity 9. Also shown is an inlet spout 80 to pour fluid 72 into the foundation 1 electrical/data devices enclosure 35 and leader bore to facilitate engaging, plumbing and securing the pole 22 assembly employing the I-cap 100 to the foundation 1.

FIG. 1E shows an enlarged and exploded perspective of top of foundation 93. Also shown are the compressive filler/elastomeric compound 37, the pole 22, the top of the monolithic I-cap 78, pole anti-rotation/uplift bolt 19, and the top of foundation 93. The monolithic I-cap enclosure 100 slides down the pole 22 shaft and engages the pole 22 by plurality of bolts 19. The bolts 19 are inserted through the pole cavity 9 wall and the monolithic I-cap enclosure 100. Once the I-cap enclosure 100 is secured in place, the compressive filler/elastomeric compound 37 is placed in the I-cap recess 88 to protect the pole cavity 9 against moisture entry.

FIG. 1F shows an enlarged exploded perspective of top of foundation 93. Also shown are the compressive filler/elastomeric compound 37, the pole 22, the two-part I-cap enclosure top 79, the pole plumbing and anti-rotation/uplift bolt 19, and the top of foundation 93. The two-part I-cap enclosure 100 is inserted into the pole cavity 9 embracing the pole at their inner walls and the pole cavity 9 with their outer walls. Then, bolts 19 are inserted through the pole cavity 9 wall and through the I-cap enclosure 100, plumbing or securing or plumbing and securing the pole 22. Then, compressive filler/elastomeric compound 37 is placed in the I-cap recess 88 to protect the pole cavity 9 against moisture entry. Bolt 19 can be engaged a threaded bore in the pole cavity 9 wall, in the I-cap 100 or both.

FIGS. 2A and 2B show top and bottom perspectives of the I-cap enclosure 79 monolithic embodiment. FIG. 2A shows the I-cap recess 88, the inner wall 85, the top 81, the outer wall 84, and a through bore 83. FIG. 2B shows the cap's lip 86, the outer wall 84, the inner wall 85, a through bore 83, and a cap's bottom face 82. The I-cap enclosure slides down along the pole 22 shaft and is wedged between the pole 22 and the pole cavity 9 at the top of the pole cavity 11. The through bores 83 are aligned with the through bolt port 92 in the pole cavity 9 wall and bolts 19 secure the pole 22 and the I-cap to the foundation 1.

FIGS. 2C and 2D show bottom and top perspectives of half of a multi-part I-cap enclosure 79. In this embodiment the two parts are joined together after the pole 22 shaft rests on the pole cavity 9 tapered structure 21. The multi-part I-cap 79 is inserted at the top of the pole cavity 11 having an overlapping lip 86 to direct moisture away from the pole 22 toward the exterior edge of the pole cavity top 11. FIG. 2C shows the cap's lip 86, the outer wall 84, a through bore 83, and the inner wall 85. FIG. 2D shows the top of the I-cap 81 recess 88 into which compressive filler/elastomeric compound 37 is placed, a through bore 83, and the cap's inner wall 85. Also shown are two enlarged sections designators showing the I-cap's interlocking lips 86 in more detail.

FIG. 2E-E shows a partial section of the multi-part I-cap 79 enclosure interlock at the seam 87 and the cap's top lip 89 is keyed into the cap's bottom lip 96. The multi-part I-cap enclosure 79 cross-section may include voids 90 reducing its weight and material without compromising its ability to transfer the pole's 22 lateral loads to the foundation 1. The voids may be enclosed by radial spokes originating at the multi-part I-cap's enclosure's 79 inner wall 85 terminating at the outer wall 84.

FIG. 2F-F shows a partial transverse section at the top of the pole cavity 11 centered between the pole 22 and the pole cavity wall 47. Wedged between them is the I-cap enclosure 100 having an overhang over the top of the pole cavity wall 47 lip 86. The top of the I-cap 81 is sloped outwardly and down from the face of the pole 22 and compressive filler/elastomeric compound 37 occupies a recess 88 in the I-cap enclosure's 100 top inner wall 85. Also shown are a bolt 19 extending from the pole cavity wall 47 through the I-cap enclosure 100, extending into the pole 22 wall. This embodiment shows the I-cap enclosure through bore 46 threaded. In other embodiments the I-cap enclosure 100 bore can be smooth faced.

Figure 3A:
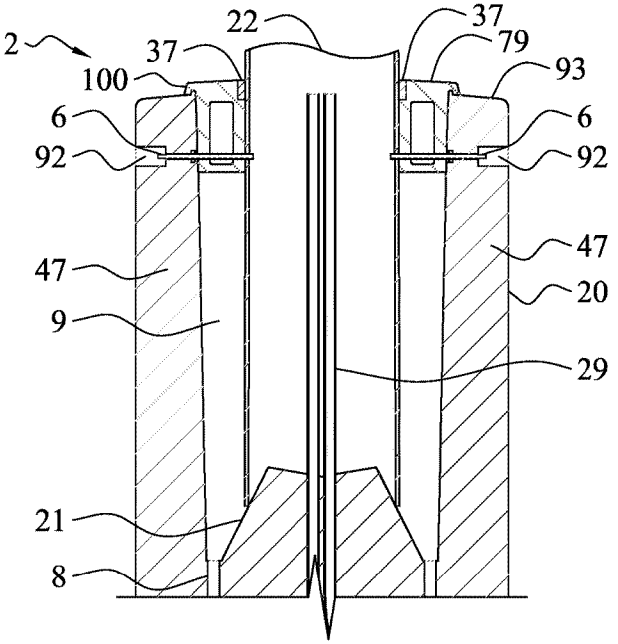
FIG. 3A is a section showing the I-cap inside the pole cavity with a through bolt engaging the pole.

FIG. 3A shows a section through the pole cavity 9. At the vertical center of the cavity resting on a tapered structure 21 is a pole 22 with conduits 29 running at its center. Below and away from the tapered structure 21 a through opening 8 evacuates any trapped moisture inside the pole cavity 9. At the top of the pole cavity, wedged between the pole cavity wall 47 and the pole 22 is the I-cap enclosure 100. The enclosure caps the top of the foundation 93 preventing moisture travel into the pole cavity 9. The enclosure also aligns and secures the pole to the foundation 1 employing bolts 19. The bolts are inserted and torqued inside the exterior of the foundation wall through bolt ports 92. Following installation, the ports can be filled and capped.

Figure 3B:
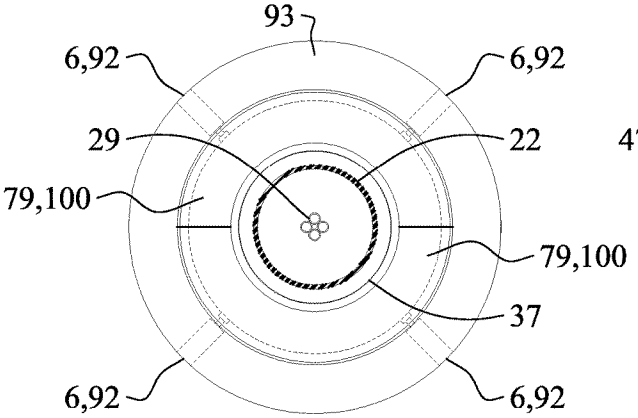
FIG. 3B shows the same assembly in plan view.

FIG. 3B shows a plan view of section 3A (above) employing multi-part I-cap enclosure 79. Also shown are conduits 29, the pole 22, the top of foundation 93, compressive filler/elastomeric compound 37, and in dash line below a plurality of through bolt ports 92.

FIG. 3C shows a partial enlargement of the top of the pole cavity wall 47 with the I-cap enclosure 100 wedged between the pole cavity wall 47 and the pole 22. This partial enlargement shows a recess 39 in the inner wall of the pole cavity 9 and a threaded insert plate 40 through which the bolt 19 is threaded. This fastening method is one example of several methods to plumb and secure the pole. Other methods may include a threaded I-cap enclosure and/or prefabricated threads inside the pole cavity wall 47.

FIGS. 4A and 4B show the multi-part I-cap enclosure 79 in plan and elevation views inside a round pre-fabricated pole foundation 1. FIG. 4A shows the top of the foundation 93, the pole 22, conduits 29, compressive filler/elastomeric compound 37, multi-part I-cap enclosure 79 and through bolt ports 92. FIG. 4B shows the pole 22 inside multi-part I-cap enclosure 79 on a round pre-fabricated foundation 1 with a through bolt port 92.

FIGS. 4C and 4D show a monolithic I-cap enclosure 78 in plan and elevation views inside a squared pre-fabricated pole foundation 1. FIG. 4C shows the top of the foundation 93, the pole 22, conduits 29, compressive filler/elastomeric compound 37, monolithic I-cap enclosure 78, and through bolt ports 92. FIG. 4D shows the pole 22 inside the monolithic I-cap enclosure 88 on a square pre-fabricated foundation 1 with a through bolt port 92.

FIGS. 4E and 4F show the multi-part I-cap enclosure 79 in plan and elevation views inside an octagonal pre-fabricated pole foundation 1. FIG. 4E shows the top of the foundation 93, the pole 22, conduits 29, compressive filler/elastomeric compound 37, multi-part I-cap enclosure 79 and through bolt ports 92. FIG. 4F shows the pole 22 inside multi-part I-cap enclosure 79 on an octagonal pre-fabricated foundation 1 with a through bolt port 92.

Figure 5A:
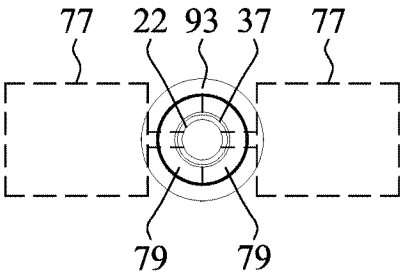
FIGS. 5A-5B and 5C-5D show two pole assemblies top and side views.

FIG. 5A shows a plan view of a pole assembly employing two luminaire 77 resting in a pre-fabricated foundation 1 with a monolithic I-cap enclosure 78 engaging the pole 22 in the foundation's pole cavity 9.

Figure 5C:
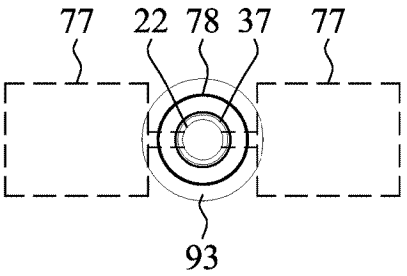
Figure 5B:
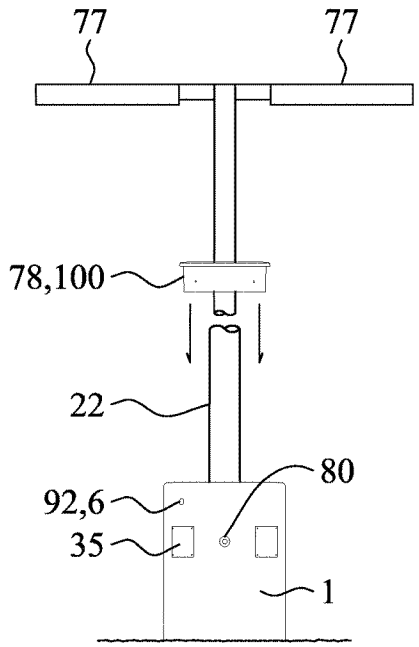

FIG. 5B shows the assembly of FIG. 5A in elevation with the monolithic I-cap enclosure 78 lowered along the pole 22 shaft into position upon resting the pole assembly on the tapered structure 21 at the bottom of the pole cavity 9. Also shown is an inlet spout 80 to pour fluid 72 into the foundation 1. Electrical/data devices enclosure 35 and leader bore to facilitate engaging, plumbing and securing the pole 22 assembly employing the I-cap 100 to the foundation 1.

FIG. 5C shows a plan view of the pole assembly employing two luminaires 77 resting in a pre-fabricated foundation 1 with multi-part I-cap enclosure 79 engaging the pole inside the foundation's pole cavity 9.

Figure 5D:
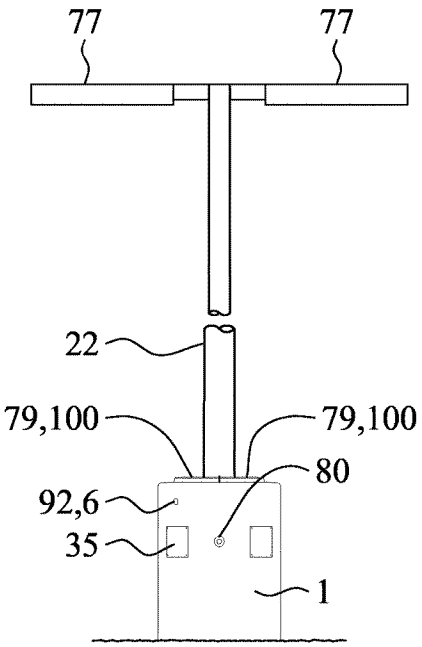

FIG. 5D shows the assembly of FIG. 5C in elevation with the multi-part I-cap enclosure 79 engaging the pole 22 and the foundation 1 and providing moisture protection to the pole cavity 9. Also shown is an inlet spout 80 to pour fluid 72 into the foundation 1 electrical/data devices enclosure 35 and leader bore to facilitate engaging and securing the pole 22 assembly and the I-cap 100 to the foundation 1.

Figure 5E:
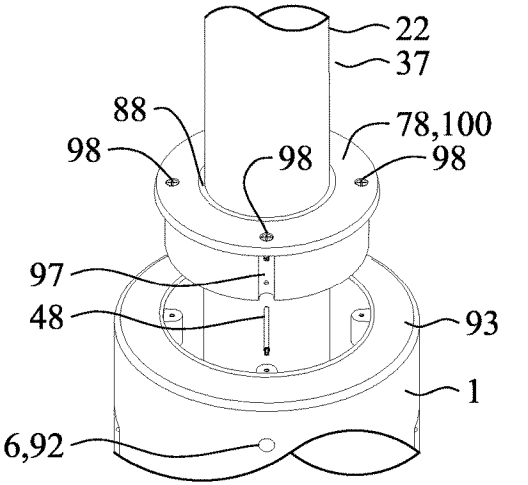
FIGS. 5E and 5F show enlargements of two embodiments.

FIG. 5E shows an enlarged and exploded perspective of top of foundation 93. Also shown are the compressive filler/elastomeric compound 37 (for this illustration purpose higher than its true location at recess 88 below), the pole 22, the top of the monolithic I-cap 78 and pole anti-rotation/uplift bolt 48. The monolithic I-cap enclosure 100 slides down the pole 22 shaft and engages the pole 22 by at least one bolt 48. The bolt 48 is inserted through the pole cavity 9 wall and the monolithic I-cap enclosure 100. Once the I-cap enclosure 100 is secured in place, the compressive filler/elastomeric compound 37 is placed in the I-cap recess 88 to protect the pole cavity 9 against moisture entry.

Figure 5F:
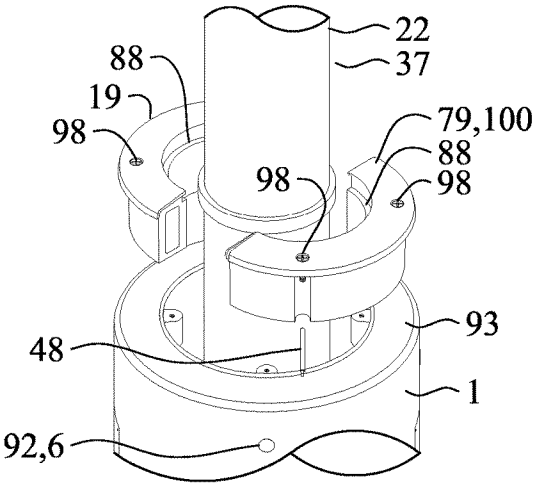

FIG. 5F shows an enlarged exploded perspective of top of foundation 93. Also shown are the compressive filler/elastomeric compound 37, the pole 22, the two-part I-cap enclosure top 79, the pole anti-rotation/uplift bolt 48, and the top of foundation 93. The two-part I-cap enclosure 100 is inserted into the pole cavity 9 embracing the pole at their inner walls and the pole cavity 9 with their outer walls. Then, I-bolts 48 are inserted through the pole cavity 9 wall and through the I-cap enclosure 100, securing the pole 22. Then, compressive filler/elastomeric compound 37 is placed in the I-cap recess 88 to protect the pole cavity 9 against moisture entry. Bolt 48 can be engaged a threaded bore in the pole cavity 9 wall, in the I-cap 100 or both.

FIGS. 6A and 6B show top and bottom perspectives of the I-cap enclosure 79 monolithic embodiment. FIG. 6A shows the I-cap recess 88, the inner wall 85, the top 81, the outer wall 84, and a through bore 83, top bore 98 and I-Cap keyed lock 97. FIG. 6B shows the cap's lip 86, the outer wall 84, the inner wall 85, a through bore 83, the cap's bottom face 82 and the I-Cap lock 97. The I-cap enclosure slides down along the pole 22 shaft and is wedged between the pole 22 and the pole cavity 9 at the top of the pole cavity 11. The I-Cap's top bolt/s mounted from above, secure the enclosure to the foundation 1. Bolt/s 48 through bolt port 92 in the pole cavity exterior wall 9 secure the pole 22 and the I-Cap 100 to the foundation 1.

FIGS. 6C and 6D show bottom and top perspectives of half of a multi-part I-cap enclosure 79. In this embodiment the two parts are joined together after the pole 22 shaft rests on the pole cavity 9 tapered structure 21. The multi-part I-cap 79 is inserted at the top of the pole cavity 11 having an overlapping lip 86 sloped to direct moisture away from the pole 22 toward the exterior edge of the pole cavity top 11. FIG. 6C shows the cap's lip 86, the outer wall 84, a through bore 83, and the inner wall 85. FIG. 6D shows the top of the I-cap 81 recess 88 into which compressive filler/elastomeric compound 37 is placed, a through bore 83, and the cap's inner wall 85. Also shown are bores 98 and the I-Cap keyed lock 97.

FIG. 6E-E shows a partial section of the multi-part I-cap 79 enclosure interlock at the seam 87 and the cap's top lip 89 is keyed into the cap's bottom lip 96. The multi-part I-cap enclosure 79 cross-section may include voids 90 reducing its weight and material without compromising its ability to transfer the pole's 22 lateral loads to the foundation 1. The voids may be enclosed by radial spokes originating at the multi-part I-cap's enclosure's 79 inner wall 85 terminating at the outer wall 84.

FIG. 6F-F shows a partial transverse section at the top of the pole cavity 11 centered between the pole 22 and the pole cavity wall 47. Wedged between them is the I-cap enclosure 100 having an overhang over the top of the pole cavity wall 47 lip 86. The top of the I-cap 81 is sloped outwardly and down from the face of the pole 22 and compressive filler/elastomeric compound 37 occupies a recess 88 in the I-cap enclosure's 100 top inner wall 85. Bolt 48 inserted at the top of the I-Cap enclosure 100 secures the I-Cap to the foundation. The foundation's top lip 89 may compress a gasket wedged below the bottom overhung lip of the I-Cap 100. Also shown is bolt 48 extending from the pole cavity wall 47 through the I-cap enclosure 100, into the pole's 22 wall. This embodiment shows the I-cap enclosure through bore 46 threaded. In other embodiments the I-cap enclosure 100 bore can be smooth faced.

Figure 7C:
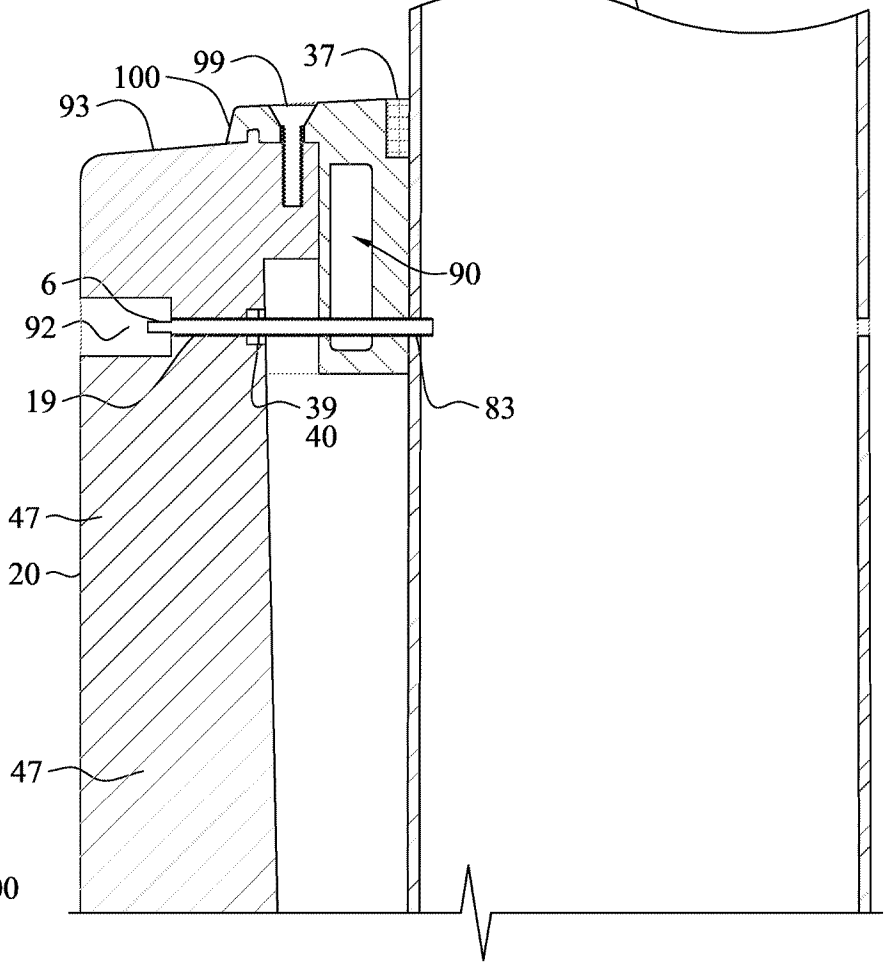
FIG. 7C shows an enlarged section of the I-Cap at the top of the foundation employing a bolt to secure the I-Cap to the foundation.
Figure 7A:
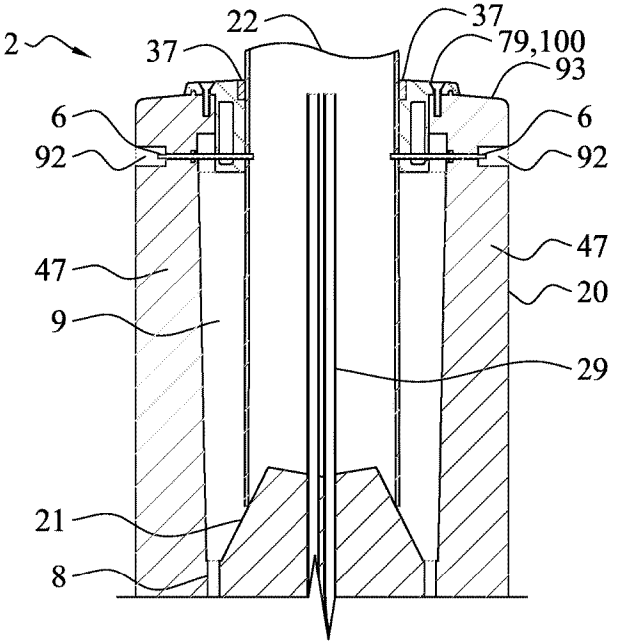
FIG. 7A is a section showing the I-cap inside the pole cavity with a through bolt engaging the pole.

FIG. 7*a* shows a section through the pole cavity 9. At the vertical center of the cavity resting on a tapered structure 21 is a pole 22 with conduits 29 running at its center. Below and away from the tapered structure 21 a through opening 8 evacuates any trapped moisture inside the pole cavity 9. At the top of the pole cavity, wedged between the pole cavity wall 47 and the pole 22 is the I-cap enclosure 100. The enclosure caps the top of the foundation 93 preventing moisture travel into the pole cavity 9. The enclosure also secures the pole to the foundation 1 employing bolts 48. The bolts are inserted and torqued inside the exterior of the foundation wall through bolt ports 92. Following installation, the ports can be filled and capped.

Figure 7B:
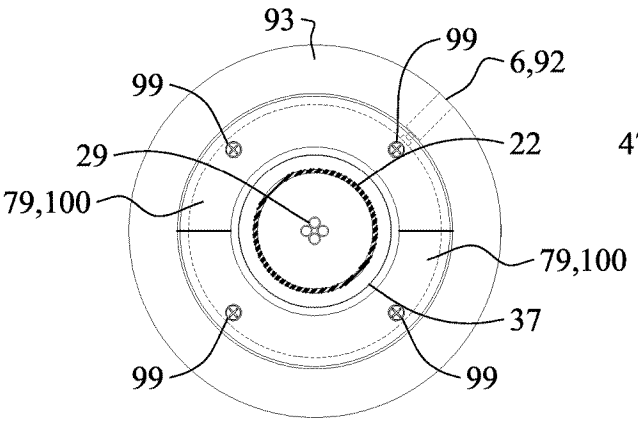
FIG. 7B shows the same assembly in plan view.

FIG. 7B shows a plan view of section 7A (above) employing multi-part I-cap enclosure 79. Also shown are I-cap top bolts 99, conduits 29, the pole 22, the top of foundation 93, compressive filler/elastomeric compound 37, and in dash line below a through bolt port 92.

FIG. 7C shows a partial enlargement of the top of the pole cavity wall 47 with the I-cap enclosure 100 wedged between the pole cavity wall 47 and the pole 22. This partial enlargement shows a recess 39 in the inner wall of the pole cavity 9 and a threaded insert plate 40 through which the bolt 48 is threaded. This fastening method is one example of several methods to secure the pole. Other methods may include a threaded I-cap enclosure and/or pre-fabricated threads inside the pole cavity wall 47. Also shown is an I-cap top bolt 99 fastened into the foundation lock bore 102, securing the I-cap 100 to the foundation 1.

FIGS. 8A and 8B show the multi-part I-cap enclosure 79 in plan and elevation views inside a round pre-fabricated pole foundation 1. FIG. 8A shows the top of the foundation 93, the pole 22, conduits 29, compressive filler/elastomeric compound 37, multi-part I-cap enclosure 79 and through bolt ports 92. FIG. 8B shows the pole 22 inside multi-part I-cap enclosure 79 on a round pre-fabricated foundation 1 with a through bolt port 92. The I-cap 100 in this embodiment is secured to the foundation 1 employing four I-cap top bolts 99.

FIGS. 8C and 8D show a monolithic I-cap enclosure 78 in plan and elevation views inside a squared pre-fabricated pole foundation 1. FIG. 8C shows the top of the foundation 93, the pole 22, conduits 29, compressive filler/elastomeric compound 37, monolithic I-cap enclosure 78, and through bolt ports 92. FIG. 8D shows the pole 22 inside the monolithic I-cap enclosure 88 on a square pre-fabricated foundation 1 with a through bolt port 92. The I-cap 100 in this embodiment is secured to the foundation 1 employing four I-cap top bolts 99.

FIGS. 8E and 8F show the multi-part I-cap enclosure 79 in plan and elevation views inside an octagonal pre-fabricated pole foundation 1. FIG. 8E shows the top of the foundation 93, the pole 22, conduits 29, compressive filler/elastomeric compound 37, multi-part I-cap enclosure 79 and through bolt ports 92. FIG. 8F shows the pole 22 inside multi-part I-cap enclosure 79 on an octagonal pre-fabricated foundation 1 with a through bolt port 92. The I-cap 100 in this embodiment is secured to the foundation 1 employing four I-cap top bolts 99.

Second Embodiment

Pole Foundation Erection Process

The conventional "pour-in-place" pole foundation construction and pole erection process entails the following steps:

a. Ordering materials such as steel rebar, gravel, plywood, and forms;
b. Scheduling onsite drop ship dates for the above materials;
c. Ordering luminaires and poles, often requiring that anchor bolts pre-ship prior to balance of order arrival;
d. Constructing the steel cage for the concrete foundation structural reinforcement;
e. Constructing plywood templates for the anchor bolts and secure the bolts with the template to cage;
f. Scheduling a date for concrete pour;
g. Augering foundation bores and, where needed, providing bedding material for the foundation (weather permitting);
h. Lowering forms with rebar cage into bores, plum and secure them, or dropping the steel rebar cages into forms after the forms were plumbed and secured in bores. The steel rebar cages could be inserted inside the form or following;
i. Making all pre-pour electrical connectivity prep work;
j. Backfilling and compacting soil around the forms if needed;
k. Scheduling a crane for pole standing;
l. Pouring concrete, vibrating inside the forms and waiting until concrete cures (weather permitting);
m. Assembling pole and luminaire(s) and/or other devices;
n. Using a crane, lower pole assembly on pole base securing pole to foundation with anchor bolts nuts;
o. Adjusting anchor bolts' nuts to plumb the pole;
p. Removing above grade forms and refinishing the foundation surfaces;
q. Pulling all electrical wire and securing the hand hole cover to pole;
r. Placing pole base cover or architectural nut covers on pole base plate;
s. Refinishing/touching up any scratches, and removing dirt from pole and foundation base; and
t. Powering up pole-mounted devices and verifying proper operation.

The present innovation of pole foundation construction and pole erection process is rapid requiring fewer steps:

a. Ordering foundation, foundation components, pole and luminaires;
b. Augering bores in the soil and bedding the bores' bottom if needed;
c. Lowering pre-casted foundation into the bores;
d. Pulling below grade power into the foundation;
e. Backfilling and compacting soil around the foundation;
f. Lowering a pole with luminaires, absent a base plate, into the foundation pole cavity;
g. Securing the pole assembly using bolts inserted from the foundation wall;
h. Sealing gap between pole and foundation with elastomeric compound;
i. Touching up any scratches and removing dirt from pole and foundation base; and
j. Trimming all electrical connections, powering up and verifying that all luminaires and/or other devices operate properly.

Coupled with the art described in the parent patent and continuation 01, this innovative foundation construction and pole erection reduce 10 steps from the conventional foundation construction and pole erection.

The pre-fabricated foundation employs state of the art manufacturing technologies reducing on-site manual labor. This reduction lowers the overall production costs and the likelihood of bad weather having an adverse impact on the construction schedule. The innovation enhances its parent patent and continuation 01, by streamlining creating an all-in-one foundation streamlining the entire foundation and pole erection process.

About the Foundation

The foundation can be manufactured just-in-time having information at hand about the pole shaft dimensions specified. Today's fabrication technology is capable of producing complex forms in real time. For example, 3D components are printed in-real-time at the space station by an uplink from Earth. The pole rests on either a flat or tapered structure at the bottom of the pole cavity with a through opening to enable moisture to evacuate the cavity. The pole is secured to the foundation using at least one through bolts. The bolt is inserted through the pole cavity wall and can penetrate the exterior wall of the pole. A recess at the aperture opening of the pole cavity enables sealing the gap between the pole cavity and pole from moisture penetration. The sealer can be a compressive filler and/or an elastomeric compound.

The all-in-one foundation:

a. Transfers the pole's lateral loads to the foundation's walls
b. Is the pole's anti-rotation lock
c. Is the pole's anti-uplift lock
d. Can facilitate pole alignment
e. Prevents moisture from entering the foundation's pole cavity The present innovation can employ two of the parent patent key elements: a tapered structure at the pole cavity's bottom center, and a pole alignment/anti-rotation/anti-uplift device at the upper portion of the pole cavity's walls.

The foundation is fabricated from substantially non-corrosive hardened material, resistant to the elements including minerals such as salt and common urban/industrial pollutants. The device manufacturing methods include but are not limited to 3D printing and injection molding. Employing 3D printing employing polymer molten resin are similar material, innovate the foundation fabrication process adding design flexibility while reducing production time. For example, the foundation pole cavity opening complements any form the pole's profile may have. Also, the foundation's exterior walls form can be fabricated to complement the pole's cross-sectional profile. Structural calculations can also be executed in real-time by employing design software with predictable material properties stored. The foundation can be fabricated from a single monolithic embodiment, or made of several embodiments joined together by mechanical means.

The foundation possesses the following common properties, regardless of its form:

a. It has at least one through bore in its body enabling bolt/s to engage the pole. The bore may be threaded or non-threaded.
b. Its pole cavity's inner circumference, in part or in whole, abuts the outer face of the pole.
c. Its outer top face is sloped away from the pole exterior face.
d. It has a recess at the pole cavity's aperture opening for placement of sealing material between the exterior face of the pole and the foundation preventing moisture travel to the pole cavity.

Other Foundation Features

The foundation can employ cellular structure and contain volumetric enclosure/s. Both structures and particularly the cellular structure can be easily fabricated today by means of 3D printing. As a result, the foundation to site weight is reduced and the foundations are easier to handle posing lesser risk to injury. Following foundation embedment, if additional weight is needed, through an inlet spout at the exterior face of the foundations' pole cavity wall fluid can enter the cells the foundation's cells and/or the volumetric enclosure.

Figures 9A, 9B, 9C, 9D:
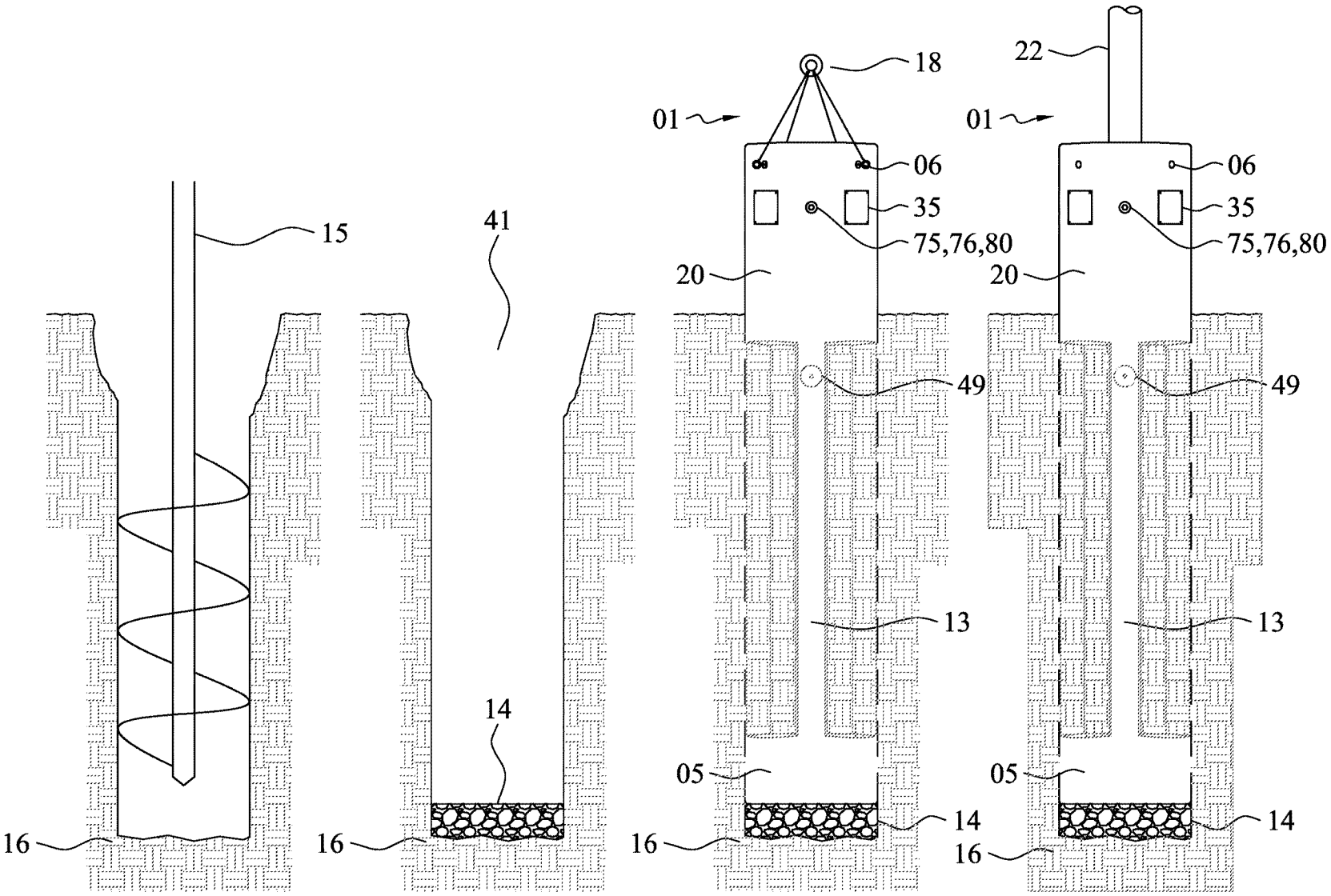
FIGS. 9A-9B show elevation views and 9C-9D show sections of two foundations core profiles retaining the embedded pole.

FIGS. 9A-D show the pre-fabricated pole foundation placement process inside an augered bore in the soil. Similar Figs. are shown in Spiro's parent U.S. Pat. No. 9,777,456 B1. In FIG. 9A the bore is augered. In FIG. 9B the bottom of the bore is bedded. In FIG. 9C the pre-fabricated foundation employing external I looped bolts engaged threaded lift bores 47 located at the exterior wall of the pole cavity 20. The I loop/s facilitate lifting the foundation/s from the truck and lowering them inside the augered bore 41. The same I loop bores can be used to plumb the foundation (not shown). Since the pole 22 is fully aligned inside with the foundation's pole cavity 9, there is no need to align the pole. The alignment is required is for the foundation. FIG. 9D shows fill material 17 around the foundation. The fill is poured and compacted following pulling power/data conductors into the foundation structure. The pole 22 then simply lowered into the pole cavity 9 and is secured to the foundation 1 by at least one pole bolt 25. Other elements shown: the outlet or inlet spout 76,80 and a valve 75.

FIG. 10A shows an elevation of a pre-fabricated pole foundation employing a cruciform core section 4. At the vertical center of the core section 4, a volumetric enclosure 73 reduce the shipping weight of the foundation 1 and eases the foundation handling also reducing injury risk. On-site, the volumetric enclosure 73 can be filled with fluid 72 when additional foundation weight is needed. Fluid 72 enters the foundation cellular structure 70 and/or the volumetric enclosure 73 through an inlet spout 80 located at the foundation's exterior wall 68. The spout may also act as an outlet spout 76 and a breather valve 75. Also shown are the foundation's exterior walls 95 including the pole cavity wall 20, top of foundation's base section 94, base section 5 and electrical/data enclosure 35.

FIG. 10A-A is a vertical section through the center of the foundation 1 for the foundation embodiment shown in FIG. 10A. At the core section 5, a volumetric enclosure 73 may contain fluid 72. The fluid reaches the volumetric enclosure 73 through a pipe 74 embedder or integral to the pole cavity wall. The pipe 74 originates next to the inlet spout 80 located at the exterior wall of the pole cavity 20. In different embodiments, the fluid 72 can perforate through the cellular structure 70 inside the foundation's walls or both the cellular structure 70 and the volumetric enclosure 73.

Pole 22 is shown slide down the walls of the pole cavity 20 and rests on a tapered structure 21 at the bottom of the pole cavity 9 with through opening 8 facilitating a mean for moisture to evacuate the cavity. In another embodiment, the pole rests on a flat surface whereas the through openings 8 are depressed. At the top of the cavity, a recess at the aperture of the pole cavity wall 39 retains compressive filler/elastomeric compound 37 to prevent moisture entering the pole cavity 9. The pole 22 is secured to the foundation by engaging pole bolt/s through bolt port/s 92 at the foundation's exterior wall 95. FIG. 10B-B is like FIG. 10A-A except perforated openings inside the volumetric enclosure 73 permit fluid 72 travel into the foundation's walls cellular structure 70 and/or to the foundation's base section 5.

FIG. 10B shows an elevation of a pre-fabricated pole foundation employing a round core section 4. At the vertical center of the core section 4, a volumetric enclosure 73 reduce the shipping weight of the foundation 1 and eases the foundation handling also reducing injury risk. On-site, the volumetric enclosure 73 can be filled with fluid 72 when additional foundation weight is needed. Fluid 72 enters the foundation cellular structure 70 and/or the volumetric enclosure 73 through an inlet spout 80 located at the foundation's exterior wall 68. The spout may also act as an outlet spout 76 and a breather valve 75. Also shown are the foundation's exterior walls 95 including the pole cavity wall 20, top of foundation's base section 94, base section 5 and electrical/data enclosure 35.

FIG. 10C-C is a vertical section through the center of the foundation 1 for the foundation embodiment shown in FIG. 10B. At the core section 5, a volumetric enclosure 73 may contain fluid 72. The fluid reaches the volumetric enclosure 73 through a pipe 74 embedder or integral to the pole cavity wall. The pipe 74 originates next to the inlet spout 80 located at the exterior wall of the pole cavity 20. In different embodiments, the fluid 72 can perforate through the cellular structure 70 inside the foundation's walls or both the cellular structure 70 and the volumetric enclosure 73.

Pole 22 is shown slide down the walls of the pole cavity 20 and rests on a tapered structure 21 at the bottom of the pole cavity 9 with through opening 8 facilitating a mean for moisture to evacuate the cavity. In another embodiment, the pole rests on a flat surface whereas the through openings 8 are depressed. At the top of the cavity, a recess at the aperture of the pole cavity wall 39 retains compressive filler/elastomeric compound 37 to prevent moisture entering the pole cavity 9. The pole 22 is secured to the foundation by engaging pole bolt/s through bolt port/s 92 at the foundation's exterior wall 95. FIG. 10D-D is like FIG. 10C-C except perforated openings inside the volumetric enclosure 73 permit fluid 72 travel into the foundation's walls cellular structure 70 and/or to the foundation's base section 5.

FIGS. 11A, 11B-B and 11C show enlargements of the volumetric enclosure 73 and the cellular structure 70 inside the foundation walls. FIG. 11A shows the foundation elevation with horizontal section designators. FIG. 11A-A shows a partial horizontal section at the pole cavity 9. Elements enumerated include: the inlet spout 80, fluid pipe 74, cellular-structure 70, exterior wall of pole cavity 20, foundation pole, power/data conduit 29, through opening 8, tapered structure 21, and device enclosure 35. FIG. 11B-B shows a partial horizontal section at the bottom of the round core foundation above the foundation's base section 5. Elements enumerated include: cellular structure 70, top of foundation base 94, volumetric enclosure 73, cellular wall 69 and foundation exterior wall 95. FIG. 11C shows the horizontal enlarged section of the pole cavity 9 at the electrical/data enclosure 35 elevation depicting the inlet spout 80 opening and the fluid pipe 74 riser inside the cellular structure 70 wall to enable fluid 72 to travel to the volumetric enclosure 73 and/or perforate throughout the cellular walls of foundation including the base section 5.

Figure 12A:
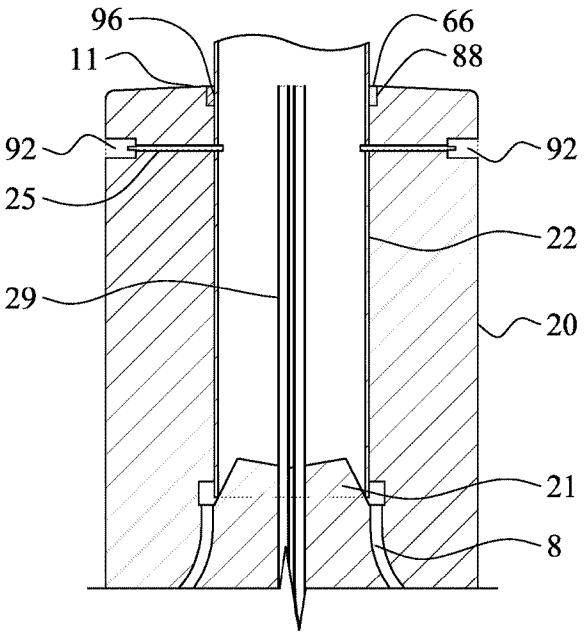
FIG. 12A show a straight wall pole embedded in a foundation pole cavity.
Figure 12B:
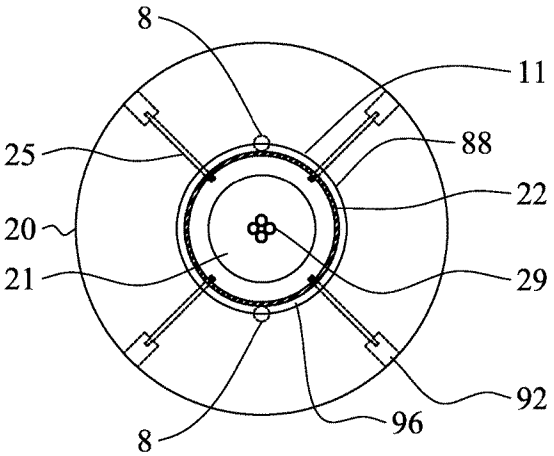
FIG. 12B shows a plan view of the above section.

FIG. 12A shows a section of the foundation's pole cavity 9 containing a pole 22 with power conduits 29 rise from the bottom center of the pole. Also located at the bottom of the cavity are through openings 8 which facilitate evacuation of trapped moisture at the cavity's bottom. In this embodiment the pole 22 is resting on a tapered structure 21. In another embodiment the pole rests on a flat surface with the through openings 8 are depressed. Bolt/s 25 lodged through the exterior wall of the pole cavity 20 secure the pole 22 from up-lift and rotation forces. The bolt/s 25 also can be used for pole plumbing when the clearance between the pole 22 and the pole cavity 9 is wide. This use can be when the foundation is adapted to retain a smaller diameter pole 22. Generally, the gap between the pole cavity 9 and the pole 22 is minimal and the pole 22 and the foundation 1 assembly plumbing is accomplished by precisely plumbing the foundation 1. The bolt/s 25 can engaged threads in the pole cavity wall or by a pole cavity inserted or embedded threaded plate 40. The same threaded bolt bores can retain an I loop lift bolts 47 to lift the foundation/s 1 off a truck and lower them into an augured bore in the soil. After securing the pole 22, the through bolt port 92 at the exterior wall of the pole cavity 20 can be plugged with a cap or capped with a sustainable non-shrink compound. At the top of the pole cavity 9 a recess at the pole aperture 96 opening retains compressive filler/elastomeric compound 37 sealing the gap between the pole 20 and the walls of the pole cavity 9 from moisture travel into the pole cavity.

FIG. 9B shows a plan view of the above FIG. 12A section. The elements shown are: through opening 8. Pole 22, compressive filler/elastomeric compound 20, tapered structure 21, conduit 29, top of pole cavity 11, pole cavity aperture recess 96, through bolt port 92, in dashed line at bottom of pole cavity through opening 8 and pole bolt 25.

Figure 12C:
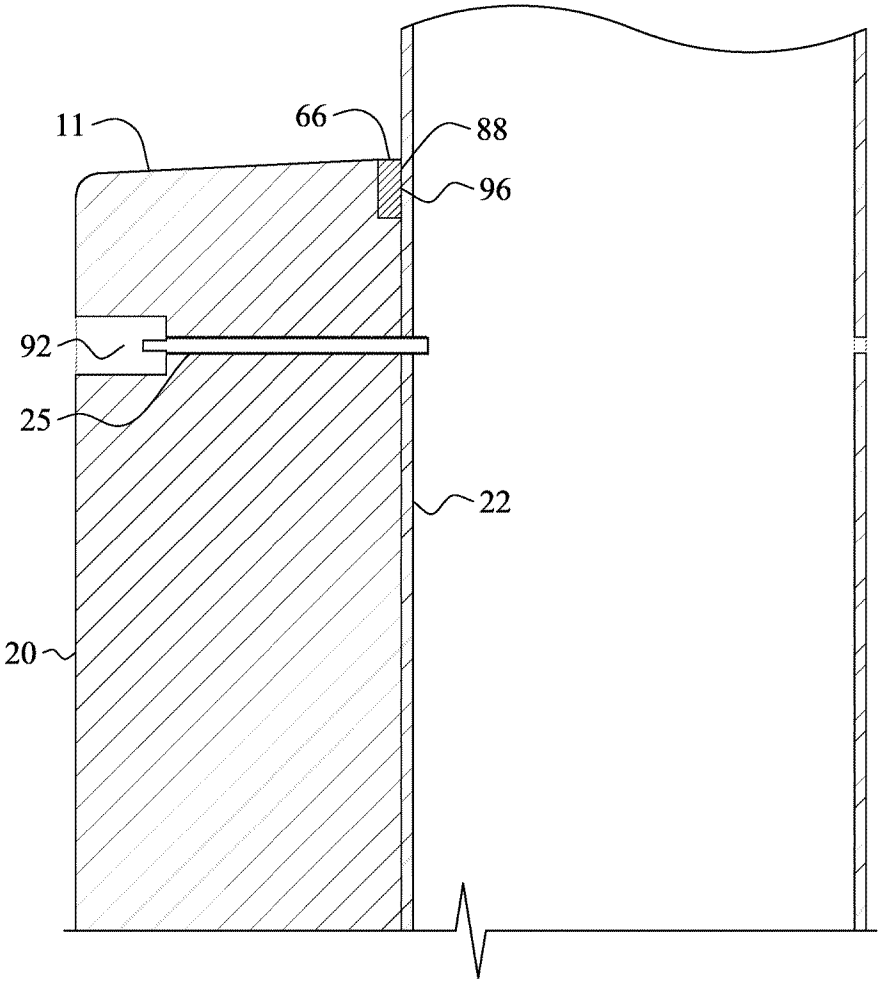
FIG. 12C shows an enlarged section of the pole cavity wall retaining a pole.

FIG. 12C shows an enlarged partial section of the pole cavity aperture 96 having a recess 39 at the top of the pole aperture filled with compressive filler/elastomeric compound 37. The pole 22 is secured to the foundation by the pole bolt 25 inserted through the exterior wall of pole cavity 20 pole port 92. In this embodiment treaded bores extend the width of the pole cavity wall. A continuous radial sloped surface removes moisture away from the top of the pole cavity 11.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A pre-fabricated pole foundation for a pole without a base plate comprising:

a pole cavity with a tapered structure located at bottom center of the pole cavity;

at least one bore in a cavity wall horizontal of the foundation's vertical axis, the at least one bore aligned with a bore located in a multi-functional cap;

the multi-functional cap extending between an exterior surface of the pole and pole cavity interior walls at proximity to a top of the pole cavity wherein, the cap retains a plurality of pole cross-sections and materials wherein, at least one through bolt radially aligned with the pole's vertical center is inserted through the exterior of the foundations' cavity wall to engage a multi-functional enclosure and the pole against rotation and uplift forces.

2. The pre-fabricated pole foundation of claim 1, wherein said cap is coupled with the tapered structure to provide pole plumbing.

3. The pre-fabricated pole foundation of claim 1, wherein said cap has a through bore radially aligned with the pole center and can be threaded to engage a bolt.

4. The pre-fabricated pole foundation of claim 1, wherein the bolt is configured to be torqued through a threaded opening in the pole cavity wall of the foundation.

5. The pre-fabricated pole foundation of claim 1, wherein the multi-functional cap is fabricated as a single, monolithic member or a plurality of interlocking members.

6. The pre-fabricated pole foundation of claim 1, wherein the structure is constructed of at least one volumetric enclosure and/or cellular structure.

7. The pre-fabricated pole foundation of claim 1, wherein said cap retains sealing material inside a recess to prevent moisture travel between the cap and the pole into the pole cavity of the foundation.

8. The pre-fabricated pole foundation of claim 6, wherein the cellular structure and/or the volumetric enclosure in the foundation retains gas, fluid or solids.

9. The pre-fabricated pole foundation of claim 1, wherein the pre-fabricated opening in an exterior wall of the foundation retains at least one power, data or power and data enclosures.

10. The pre-fabricated pole foundation of claim 1, wherein the foundation is fabricated of non-corrosive materials inert to minerals and pollutants.

11. The pre-fabricated pole foundation of claim 1, wherein the foundation is assembled using a plurality of keyed components joined mechanically.

12. A pre-fabricated pole foundation for a pole without a base plate comprising:

a body formed of cellular structure enclosure, volumetric enclosure or cellular structure and volumetric enclosure; and a pole cavity configured to receive the pole, wherein:

the pole cavity is fabricated to form a clearance between a face of a wall of the pole cavity and an outer surface of the pole when the pole is inserted within the pole cavity;

sealing material is retained inside a recess at a pole cavity aperture of the foundation;

the pole cavity is adaptable to retain a plurality of pole cross-sectional profiles without the use of forms or molds; and the foundation is configured to receive the pole secured by a bolt.

13. The pre-fabricated pole foundation of claim 12, wherein the bolt is configured to be inserted through an exterior of a wall of the foundation to secure the pole to the foundation.

14. The pre-fabricated pole foundation of claim 12, wherein the cellular structure and/or the volumetric enclosure in the foundation retains gas, fluid or solids.

15. The pre-fabricated pole foundation of claim 12, wherein a pre-fabricated opening in an exterior wall of the foundation retains at least one power, data or power and data enclosures.

16. The pre-fabricated pole foundation of claim 12, wherein bores in the foundation wall are threaded.

17. The pre-fabricated pole foundation of claim 12, wherein the foundation is fabricated of non-corrosive materials inert to minerals and pollutants.

18. The pre-fabricated pole foundation of claim 12, wherein the foundation is assembled using a plurality of keyed components joined mechanically.

19. A pole foundation comprising:

a foundation structure comprising a pole cavity with a tapered structure located at a bottom center of the pole cavity;

at least one bore in a cavity wall substantially horizontal of a vertical axis of the foundation; and a multi-functional pole foundation cap having at least one bore aligned with the at least one bore located in the cavity wall, wherein the pole foundation is configured to receive a tapered or non-tapered pole and wherein:

at least one bolt is externally inserted into the at least one bore in the pole foundation cavity wall and mechanically couples the multi-functional cap to the pole foundation cavity wall or is configured to mechanically couple the pole and the multi-functional cap to the pole foundation cavity wall; and the engaged multi-functional cap is configured to perform at least one of a) resistance to pole uplift, b) resistance to pole rotation, c) resistance to moisture entry into the pole cavity, d) align the pole with foundation, or e) architecturally detail a connection of the pole to the foundation.

20. The pole foundation of claim 19, further comprising at least one wireway and an enclosure for electrical devices, mechanical devices or electro-mechanical devices within the cavity wall of the pole cavity.

* * * * *